US005802642A

United States Patent [19]

Slaughter

[11] Patent Number: 5,802,642

[45] Date of Patent: Sep. 8, 1998

[54] LOUNGING CUSHION

[76] Inventor: Cheryl Slaughter, 3737 Sunflower Dr., Redding, Calif. 96001

[21] Appl. No.: 503,526

[22] Filed: Jul. 18, 1995

[51] Int. Cl.[6] ..... A47C 16/04

[52] U.S. Cl. ..... 5/656; 5/420; 5/652; 182/230

[58] Field of Search ..... 5/417, 420, 652, 5/656, 925, 740; 182/230

[56] References Cited

U.S. PATENT DOCUMENTS

| | | | |
|---|---|---|---|
| 2,061,604 | 11/1936 | Lincoln | 182/230 X |
| 3,323,151 | 6/1967 | Lerman | 5/420 X |
| 3,499,502 | 3/1970 | Rosander | 182/230 |
| 3,757,305 | 9/1973 | Kretchmer | 5/636 |
| 3,974,532 | 8/1976 | Ecchuya | 5/901 X |
| 4,574,101 | 3/1986 | Tricca et al. | 5/420 X |
| 4,574,411 | 3/1986 | Yagi | 5/636 |
| 4,726,087 | 2/1988 | Schaefer et al. | 5/636 |
| 4,763,756 | 8/1988 | Horan | 182/230 X |
| 4,980,936 | 1/1991 | Frickland et al. | 5/740 X |

*Primary Examiner*—Michael F. Trettel
*Attorney, Agent, or Firm*—Coudert Brothers

[57] ABSTRACT

Applicant's invention defines a lounging cushion designed to be useful primarily around a swimming pool. Key features of this invention are it's utilitarian design allowing easy storage, floatation properties so that the cushion may be used for buoyancy, simple floatation or as a kick board, and the ribbed underside allowing for drainage of water underneath so as to eliminate any suction force between the pool decking and the cushion. The cushion's main purpose is to provide a seat area at poolside which will protect a bather from catching the fabric of his or her swimsuit on the rough or abrasive decking surrounding the pool, and therefore preventing excessive wear and potential ruining of the bather's swimsuit.

12 Claims, 1 Drawing Sheet

LOUNGING CUSHION

FIELD OF THE INVENTION

Applicant's invention deals with mats and cushions, particularly as lounging accessories. Such mats or cushions are typically used around swimming pools, at sporting events, during exercise to provide a comfortable area on the floor, during work activities as knee protection, and aboard boats.

BACKGROUND OF THE INVENTION

Individual mats and cushions are available commercially for a wide range of uses including personal exercise, seat cushions for use at sporting events, seat cushions used aboard boats, and mats for use protecting one's knees while doing housework or other labor activities where kneeling is required. Such mats and cushions are available in a variety of materials, most typically of rubber or plastic foam. In the case of cushions aboard boats, construction is pillow-like, with a foam insert encased in a plastic envelope. A zipper is typically installed along one edge of the plastic insert to enable access to the foam insert.

When bathers, particularly women, sit poolside, they are at risk of damaging the seat area of their swimsuits. This risk is present because the majority of swimming pools have either "cool deck," brushed concrete, brick, tile with concrete type grout, or some other surface which is rough to prevent loss of footing and which is deliberately abrasive. The abrasive nature of these materials causes the snagging of the swimsuit, thereby ruining it.

Another use of cushions is to provide a barrier to hot or cold. At poolside, or at sporting events, cushions are often employed to provide insulation, so that the user avoids the discomfort of either losing body heat or sitting on a surface which is otherwise too hot.

Aside from outdoor furniture such as chaise lounges or chairs, the most common means of comfort poolside is provided by inflatable mattresses or towels. Inflatable mattresses are not well-suited for the uses described above for several reasons. In the first place, the mattress must be inflated, requiring time for filling, and therefore are not immediately useable. Secondly, such mattresses are typically fairly long, to accommodate the body's full length, when used in the pool. Because of their length, mattresses takes up a great deal of space when used for a cushion at the pool's edge, and do not provide the individuality of a smaller mat or cushion. Inflatable mattresses are also quite susceptible to punctures. When subjected to the weight of even a small bather, the mattress may sustain a puncture from the slightest object on the surface underneath, and the abrasive nature of the pool surface is such that these mattresses wear out quickly when used as a poolside cushion. Use of these inflatable mattresses, while common, is a misapplication, and such use typically results in the destruction of the mattress much more quickly than expected.

Mats used for kneeling while working are not suitable for use around a swimming pool because they are designed for aiding a worker rather than for recreational use. More specifically, work mats are usually too small and too pliable for recreational use and are often covered with a sticky, spongy latex coating uncomfortable against a bather's skin. Such mats, by design, are not necessarily waterproof or buoyant, and when used around water, may be subject to early degradation or decay. The undersides of these mats are typically smooth. If used around a pool, such a mat may adhere to the pool deck as a result of suction action caused by water between the smooth mat and the pool deck making picking up and moving the mat difficult.

Seat cushions from a boat have limited use as a lounging cushion. These cushions are generally somewhat expensive because of the need to meet certain safety regulations established by agencies which regulate boat safety. Therefore, such cushions are not a good economic alternative for general lounging. Also, due to the expense of these cushions, boat owners avoid using these cushions around abrasive surfaces such as pool decks. Owners are also reluctant to compromise a boat's safety by removing the seat cushions for use outside the boat. From the standpoint of design, such cushions are bulky, and better suited for water safety rather than for general purposes.

Because of the lack of suitable lounging cushion options, many persons use towels to provide the necessary protection against abrasion or heat and cold. While towels do provide such protection, they become wet and saturated, requiring bathers to have additional towels on hand to dry themselves with. Such use not only increases the burden of laundering, but wears out towels due to abrasion. Another drawback to such use is that towels fade from such use, and the materials used to make the towels degrade over time because of the chemicals used to treat the water.

What is needed is an economical cushion which can be put to immediate use, is resistant to wear, and can be inexpensively replaced. Such a cushion should be buoyant if used around a pool, without requiring inflation. In addition, the cushion should be designed to avoid adhesion to the surface it rests on and be small enough to be suitable for individual use. The ideal lounging cushion should be comfortable to use, accommodating the user's body and, if used around a pool, protective of the bather's swimwear. Such a cushion, if used around water, should also be useable as a floatation device to allow a bather to further enjoy the water safely, or even aid the bather in water exercises. Such a cushion should be resistant to water and be easily storable for immediate accessibility.

SUMMARY OF THE INVENTION

A lounging cushion according to the present invention is economical and buoyant yet requires no inflation and is therefore immediately useable. Applicant's invention also resists wear, and avoids adhesion to the surface it rests on. The present invention is designed specifically to accommodate the individual, whether the user is at poolside, or just needs insulation for a hot or cold surface. For the bather at pool's edge or in the water, the cushion has multiple uses and can be conveniently stored.

The device comprises a cushion of molded "closed cell" material which has enough buoyancy to support a bather of average weight. The preferred embodiment is made of polyethylene homopolymer, such as NMC L.D.P.E. Foam, manufactured by NMC, Inc. of Zebulon, N.C., having a specific gravity of 0.016–0.10. The invention is not limited to material supplied by the manufacturer NMC, Inc. Any polymeric or plastic foam with similar properties and a substantially low specific gravity will suffice. While such material is quite inexpensive, it is also water resistant, resistant to abrasion, and comfortable against the skin. Such closed cell materials can be utilized with enough rigidity in thicknesses of just a few inches, to prevent curling or other deformation during use, while maintaining comfort qualities. Though not a life-saving device, the cushion will allow use in the pool providing hand-holds on one side and a scalloped opposite side for comfortable positioning under the chest for floatation or kicking exercise and practice. Designed with ribs on the underside, the cushion resists adhesion to the poolside surface. Of individual size, the cushion is portable. It is also preferably provided with a hole at one end to facilitate storage of multiple units on a peg by the pool.

In order to provide additional resistance to abrasion, the cushion may be fashioned utilizing two materials of varying resistance, the lower layer being more resistant to abrasion than the top layer, thereby maintaining the desired comfort of the cushion while increasing its life and utility.

DETAILED DESCRIPTION OF THE PREFERRED EMBODIMENTS

Figure 1:
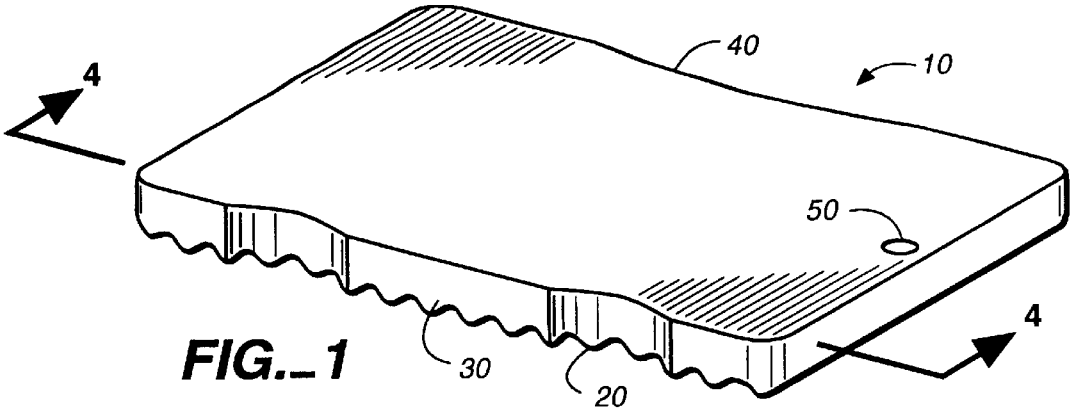
FIG. 1 is a perspective view of the invention.

In the following description, similar features in the drawings have been given similar reference numerals.

Figure 3:
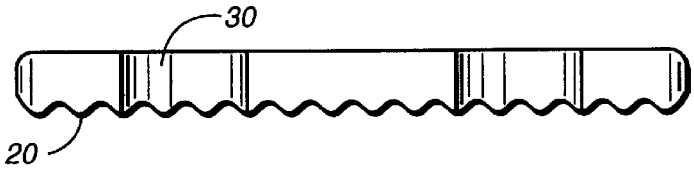
FIG. 3 is a sectional view of FIG. 1 at 4—4.

As shown in FIG. 1, applicant's cushion 10 is generally rectangular in shape, with two opposing long sides and two opposing short sides. The underside 20 of cushion 10 is of a ribbed configuration to prevent adhesion to the surface it is used on. See also FIG. 3. Hand-holds 30, are provided in the form of indentations on one of the cushions long sides, and a scalloped edge 40 is provided in the form of a longer indentation on the long side opposite said hand-holds.

Figure 2:
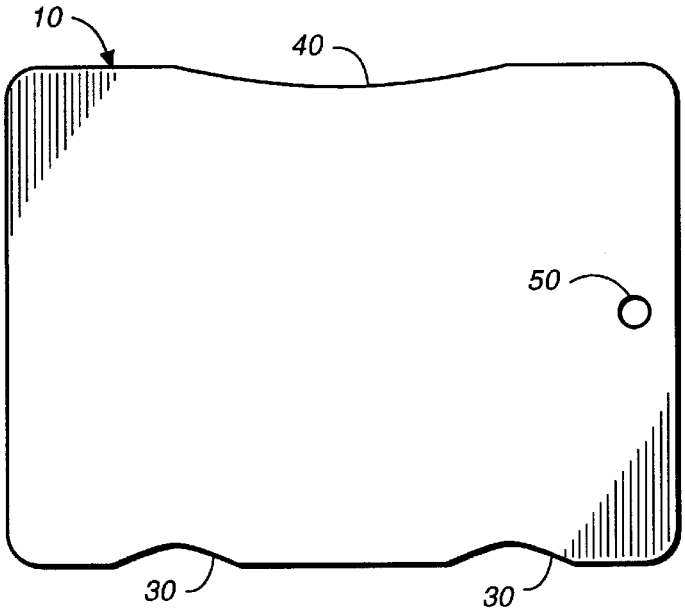
FIG. 2 is a top plan view of the invention.

A hole 50 is provided, as shown in FIG. 2, to facilitate storage of several cushions by, for example, hanging from a peg.

In a preferred embodiment, the cushion is sized approximately 11 inches wide by 17 inches long and 2 inches thick. The cushion is formed by blowing pellets of closed cell material, into a mold, thereby forming the shape of cushion 10 as described herein. NMC L.D.P.E. Foam, manufactured by NMC, Inc. of Zebulon, N.C., having a specific gravity of 0.016–0.10 is the preferred closed cell material. However, the invention is not limited to material supplied by the manufacturer NMC, Inc. Any polymeric or plastic foam with similar properties and a substantially low specific gravity will suffice. The hole provided for hanging multiple cushions is approximately 1 inch in diameter and is spaced inward approximately ¾ inch from one of the short sides of the cushion and equidistant from the cushion's long sides.

Figure 4:
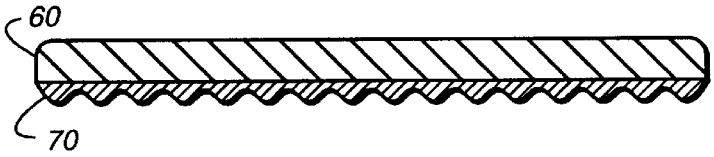
FIG. 4 is a sectional view of FIG. 1 at 4—4 for an embodiment employing two materials of varying properties.

In another embodiment, as shown in FIG. 4, two closed cell materials 60 and 70 of different densities may be used to provide a more abrasion resistant ribbed underside 20, while providing comfort to the user. The two materials may be applied either in the molding process, or by individually molding the layers and then attaching each one to the other via processes like heat laminating or hot melt gluing. In order to achieve the soft upper layer shown in FIG. 4, in the case of NMC L.D.P.E. foam, approximately two pounds (plus or minus 10%) of ethylene vinyl acetate, EVA may be used per hundred pounds of L.D.P.E. foam to make it softer and more rubbery.

While the invention has been described in connection with what is presently considered the most practical and preferred embodiments, it is to be understood that the invention is not limited to the disclosed embodiments but, on the contrary is intended to cover various modifications and equivalent arrangements included within the scope of the appended claims.

What is claimed is:

1. A lounging cushion comprising;

buoyant waterproof material of rectangular shape having two opposing long sides and two opposing short sides, said cushion having a ribbed underside, one of said cushion's long sides forming a pair of indentations, said first indentation proximate to one of said cushion's short sides, said second indentation proximate to said cushion's other short side.

2. A lounging cushion as described in claim 1 further comprising:

said other long side forming a centrally disposed single indentation along its majority opposite said pair of indentations.

3. A lounging cushion as described in claim 2 wherein:

said buoyant waterproof material comprises "closed cell" foam.

4. A lounging cushion as described in claim 2 wherein:

said buoyant waterproof material comprises polyethylene homopolymer.

5. A lounging cushion as described in claim 2 wherein:

said buoyant waterproof material comprises NMC L.D.P.E. Foam.

6. A lounging cushion as described in claim 1 further comprising:

said cushion having a hole proximate to either of said cushion's short sides.

7. A lounging cushion as described in claim 1 wherein;

said cushion having a hole spaced inward from one of said short sides and equidistant from said long sides.

8. A lounging cushion as described in claim 1 wherein;

said ribs run perpendicular to said cushion's length.

9. A lounging cushion as described in claim 1 wherein;

said cushion having an upper layer and a bottom layer of said foam, said top layer comprising an addition to said foam material of approximately 2 pounds per hundred pounds of ethylene vinyl acetate.

10. A lounging cushion as described in claim 1 wherein:

said buoyant waterproof material comprises polyethylene homopolymer.

11. A lounging cushion as described in claim 1 wherein:

said buoyant waterproof material comprises NMC L.D.P.E. Foam.

12. A lounging cushion comprising:

a waterproof, buoyant material of rectangular shape having two opposing long sides and two opposing short sides, said cushion having a ribbed underside, said ribs running perpendicular to said cushion's length, said material comprising NMC L.D.P.E. Foam;

a pair of indentations located along one of said cushion's long sides, first said indentation proximate to one of said cushion's short sides, the other said indentation proximate to said cushion's other short side;

a single indentation centrally disposed along a majority of said long side opposite said pair of indentations;

said cushion having a hole hole spaced inward from one of said short sides and equidistant from said long sides; and said cushion having an upper layer and a bottom layer of said foam, said top layer comprising an addition to said foam material of approximately 2 pounds per hundred pounds of ethylene vinyl acetate.

* * * * *